US008556731B2

(12) United States Patent
Gawel et al.

(10) Patent No.: US 8,556,731 B2
(45) Date of Patent: Oct. 15, 2013

(54) DOORFRAME FOR GAMING MACHINE

(75) Inventors: Marek Gawel, Traiskirchen (AT); Johann F. Graf, Gumpoldskirchen (AT)

(73) Assignee: Novomatic AG, Gumpoldskirchen (AU)

( * ) Notice: Subject to any disclaimer, the term of this patent is extended or adjusted under 35 U.S.C. 154(b) by 1048 days.

(21) Appl. No.: 10/575,387

(22) PCT Filed: Sep. 30, 2004

(86) PCT No.: PCT/EP2004/010929

§ 371 (c)(1), (2), (4) Date: May 14, 2007

(87) PCT Pub. No.: WO2005/041139

PCT Pub. Date: May 6, 2005

(65) Prior Publication Data

US 2007/0207861 A1 Sep. 6, 2007

(30) Foreign Application Priority Data

Oct. 8, 2003 (AU) ..... 2003100844

(51) Int. Cl.
*A63F 9/00* (2006.01)

(52) U.S. Cl.
USPC ..... 463/46

(58) Field of Classification Search
USPC ..... 463/46, 20
See application file for complete search history.

(56) References Cited

U.S. PATENT DOCUMENTS

| | | | | |
|---|---|---|---|---|
| 4,440,457 | A * | 4/1984 | Fogelman et al. | 463/46 |
| 6,068,101 | A * | 5/2000 | Dickenson et al. | 194/206 |
| 6,102,394 | A * | 8/2000 | Wurz et al. | 273/138.2 |
| 6,164,645 | A * | 12/2000 | Weiss | 273/138.2 |
| 6,227,970 | B1 * | 5/2001 | Shimizu et al. | 463/20 |
| 6,231,446 | B1 * | 5/2001 | Majima et al. | 463/46 |
| 6,311,974 | B1 * | 11/2001 | Koga | 273/118 R |
| 6,475,087 | B1 * | 11/2002 | Cole | 463/20 |
| 6,646,695 | B1 * | 11/2003 | Gauselmann | 349/58 |
| 6,659,867 | B1 * | 12/2003 | Kodachi et al. | 463/20 |
| 2002/0107075 | A1 | 8/2002 | Stephan | |
| 2003/0027627 | A1 * | 2/2003 | Cole | 463/20 |
| 2003/0222402 | A1 * | 12/2003 | Olive | 273/292 |
| 2003/0224853 | A1 * | 12/2003 | Guindulain Vidondo | 463/20 |
| 2004/0018870 | A1 * | 1/2004 | Cole | 463/20 |
| 2004/0053699 | A1 * | 3/2004 | Rasmussen et al. | 463/46 |
| 2004/0061284 | A1 * | 4/2004 | Satoh | 273/138.1 |
| 2004/0162132 | A1 * | 8/2004 | Jaffe et al. | 463/20 |
| 2004/0198485 | A1 * | 10/2004 | Loose et al. | 463/20 |
| 2005/0130746 | A1 * | 6/2005 | Stephenson et al. | 463/46 |
| 2005/0143176 | A1 * | 6/2005 | Cole | 463/46 |

(Continued)

FOREIGN PATENT DOCUMENTS

| | | |
|---|---|---|
| EP | 0886250 | 12/1998 |
| GB | 2214219 | 8/1989 |

(Continued)

*Primary Examiner* — Seng H Lim

(74) *Attorney, Agent, or Firm* — Dilworth & Barrese, LLP

(57) ABSTRACT

A doorframe is provided that uses angled display areas in a single frame to allow more than one display means to be mounted or placed behind the door with the viewing area facing outward. This allows a player to more comfortably view a multiple-display gaming machine from a single location while at the same time, allows attendants or engineers working on a gaming machine to more readily access the internal workings of the gaming machine by having to only open a single door.

22 Claims, 3 Drawing Sheets

(56) References Cited

U.S. PATENT DOCUMENTS

| | | | | |
|---|---|---|---|---|
| 2005/0277477 | A1* | 12/2005 | Hajder et al. | 463/46 |
| 2006/0073900 | A1* | 4/2006 | Cole | 463/46 |
| 2009/0325680 | A1* | 12/2009 | Tsukabe | 463/20 |

FOREIGN PATENT DOCUMENTS

| | | | | |
|---|---|---|---|---|
| GB | 2300062 A | * | 4/1995 | G07F 9/10 |
| GB | 2326505 | | 12/1998 | |
| WO | 03/028829 | | 4/2003 | |

* cited by examiner

DOORFRAME FOR GAMING MACHINE

FIELD OF THE INVENTION

The present invention relates generally to gaming consoles, gaming machines or networked gaming machines and, more particularly, to gaming machines found in casinos or betting environments. In addition the present invention relates to a doorframe assembly for a gaming machine.

BACKGROUND OF INVENTION

Most typical gaming machines provide a single display means located so as to be viewed through an open portal in a main gaming console doorframe assemblage (herein referred to as a doorframe). Below the display area on the main doorframe a control panel area is provided to allow a player to actuate any required player input with regards to controlling of the gaming machines various functions and game play, such as placing of bets, and initiating the commencement of games. Preferably, a coin input device and bill accepter are also located on or near the control panel area. In addition to the described features of a typical gaming machine, more modern gaming machines have begun to incorporate a second display area on a separate, smaller door located above the main doorframe, running at the same angle as the original single display area. Where 2 display means are provided, these machines have become known as dual monitor gaming machines, and since their introduction, have increased in popularity due to the flexibility that a second display can provide with displaying dynamic game information. The fitting of an extra display into a separate smaller top door however has also created several disadvantages. In particular, although a second display area now provides a means for changing game information, the player is now forced to view the second display area more often, and when in a seated position, this requires the player to adjust their seating or posture to do so.

The second main disadvantage, is when an attendant or engineer is performing maintenance on a dual monitor gaming machine, they are forced to open both doors so as to not obstruct their work on either of the display means. Where the doors are naturally designed to close, or simply close due to an uneven surface area, this inconvenience often leads to a time consuming duty to keep both doors open simultaneously, leaving the attendant or engineer in an acquired position when performing their respective tasks so as to not have the doors close in on them.

It is an object of the present invention to address and alleviate the problems described in the prior art discussed above, and to improve the ease of a player viewing the display means on a multiple display means gaming machine, whilst simultaneously allowing an attendant or worker to perform maintenance duties with more ease.

SUMMARY OF THE INVENTION

In accordance with the present invention, there is provided a doorframe for a gaming machine with either at least one open portal having various sections with which to view a plurality of display devices, or a number of open portals with which each may be used to view a display device. The doorframe is mounted preferably to the front of a gaming console, also known as a gaming machine, to allow a player to play a game of chance requiring a plurality of display devices which are viewable through the openings in the doorframe. Each open portal and/or section of an open portal is constructed at a varying angle to each other so that the vertical angles of the open portals or sections that meet (being the vertex of 2 given angles), are obtuse angles when viewing the front surface of the doorframe, with each display means provided being at least significantly aligned and coplanar to the angled open portal or section. This allows the display means front surface to appear to be angled towards each other rather than away from each other when viewing the front surface of the doorframe (being the surface facing the player). Ultimately this allows the player to with as little posture changing as necessary, to view 2 or more display means by merely changing the angle of their eye or with only a slight tilt of their neck.

The display means may be affixed to the inner surface of the doorframe (i.e. the surface facing away form the player) with the display means frontal surface facing the same way as the front of the doorframe. Alternatively, the display means may be affixed to the gaming console and viewable through the open portal or section in the doorframe. It is preferred that the display means will take up the entire of the section or opening provided for a display means, or in the alternative a substantial portion where any gaps are further covered by other means, such as a metal plate, foam, moulded fitting, padding around the rim or the display means or other such component designed to prevent or conceal gapping around the display device as is well known in the art.

Preferably located below the opening portals, is a control panel that runs substantially from one edge of the doorframe to the other. Alternatively the control panel may be detached from the gaming machine so as to be played from a remote location, though general within viewing range. The control panel provides a player an activation means for the game played on the gaming machine, though a touch screen display may also be used in conjunction with or as an alternative to the control panel. A coin and ticket dispenser is optionally placed on or in close proximity to the doorframe. Preferably the doorframe would also include a loyalty card input device as well known in the art.

A second important aspect to the doorframe is its ability to also allow an engineer or attendant to access all the internal workings of the gaming machine more readily. As both display means in a dual display gaming machine system will be accessible along with other internal components to the gaming machine whilst only having to open one door, the engineer or attendant as the case may be, will be relinquished of the burden of having to undo 2 locks, and hold both doors open whilst performing their work.

The display means may comprise a cathode ray tube monitor, TFT display, liquid crystal display, rear projection display, a plasma display, a back light display, physical reels, or any other display means as known in the art The art of affixing such display means to a gaming doorframe or gaming machine as well known in the art may require screws, bolts, adhesive, braces, sliding plates, rollers, frames, hinges, locks or other such means to ensure they are securely fastened.

The doorframe would preferably be rectangular in shape with equal length sides, however the actual frame width and height would depend on the model of gaming machine for which the doorframe will be attached. Alternatively, the doorframe may also vary in general shape to accommodate any further style or aesthetic presentation required by the doorframe. Preferably the doorframe would also fit snugly to a gaming machine cabinet, where the cabinet contains the internal workings of the gaming machine, and will serve to protect the otherwise exposed backings of the display means. The doorframe may be affixed to the gaming machine by many different means. More commonly, referring now to FIG. 1, a full length hinge H is affixed to both the inside rim of the doorframe and the gaming machines cabinet to accompany the weight of the doorframe, however strongly attached hinges placed at various points along the rim of the doorframe and gaming machine would also suffice. Hinge H allows rotation of the door frame 15 around axis A as shown by arrow R. Preferably, the inner wall of the gaming machine would also be re-enforced so as to accommodate the additional of any display means, where the display means have been attached to the doorframe.

BRIEF DESCRIPTION OF THE DRAWINGS

The invention will be further described by way of example with reference to the accompanying drawings, in which.

DETAILED DESCRIPTION OF PREFERRED

Figure 1:
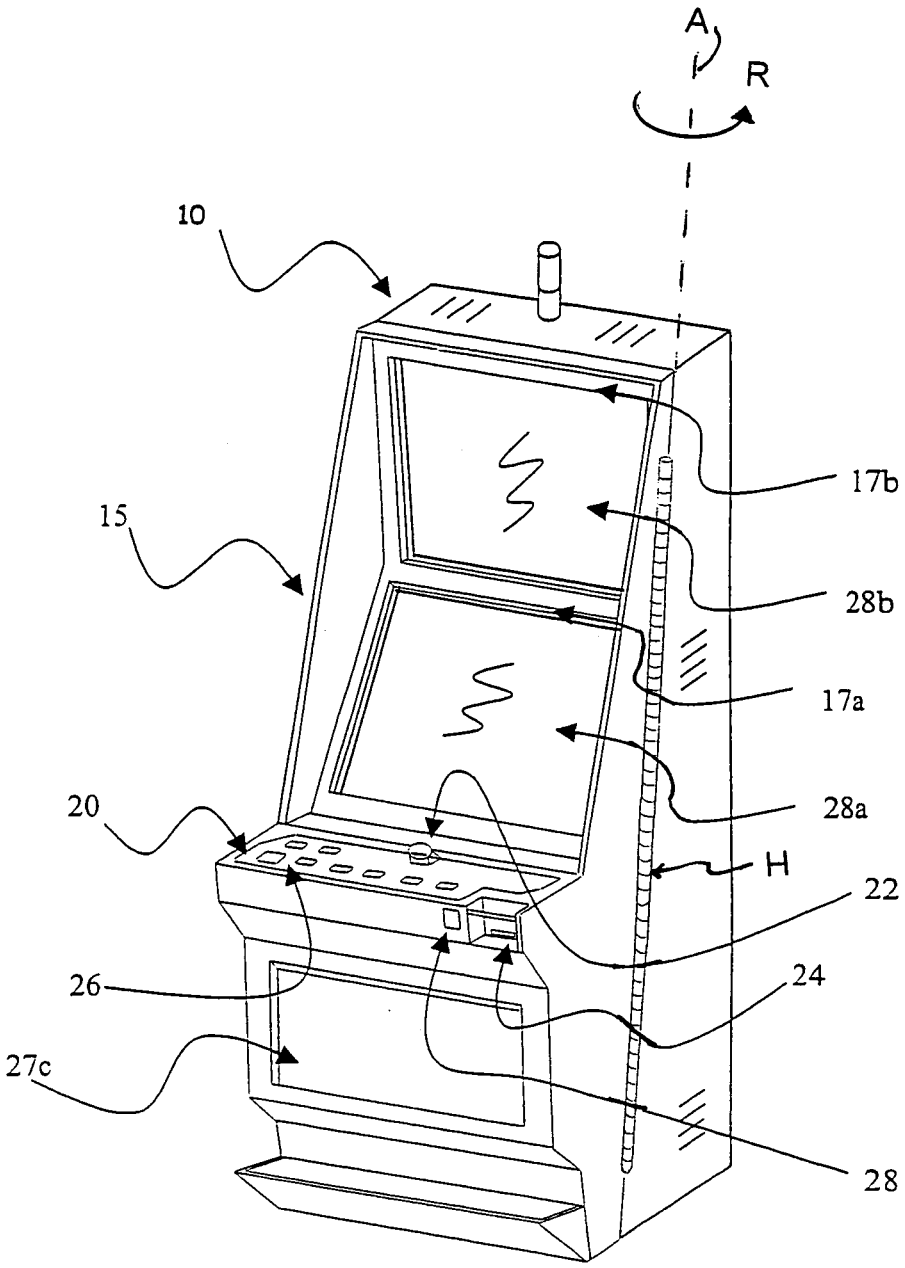
FIG. 1 is a perspective view of a gaming console according to one embodiment of the present invention.

FIG. 1 shows a gaming console 10 with a doorframe 15 attached to it, which is capable of supporting two display means 28*a* and 28*b*, being mounted on or behind the doorframe at differing angles in relation to each other. Preferably, the display means 28*a* and 28*b* are mounted one above the other, are viewable through the portals 17*a* and 17*b* respectively, and are in close proximity so as to aid the view of both display means at the same time, and aid in limiting the size of the doorframe. Other preferable features of the gaming console 10 can be found in the gaming console 10 having an operating panel 20 on which there is located a coin slot 22, a banknote slot 24, stake selectors 26, and a game initiator means 28. It should be appreciated that the operating panel 20, coin slot 22, bank note slot 24, stake selector, and game initiation means may individually or as a whole be accessible in a remote location to the gaming console 10, and may include additional controls, input or out put devices as are required. Generally, the display 28*a* and 28*b* would be used to display to the player a series of symbols or various gaming material (not shown) for which a game of chance will be played (not shown), however the displays may also be used for other purposes, such as intermittent advertising or promotional materials. A third display means, promotional material, belly panel, game rules, or game pay tables can be provided in a lower section 27*c* of the gaming console 10 if required.

Figure 2:
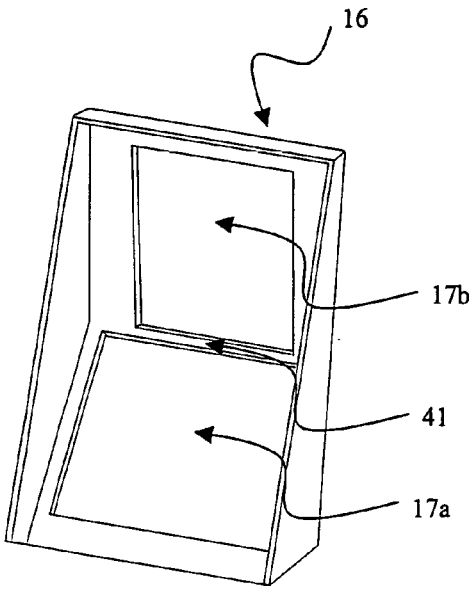
FIG. 2 is a schematic diagram of a top portion of a gaming console's doorframe with 2 open portals.
Figure 3:
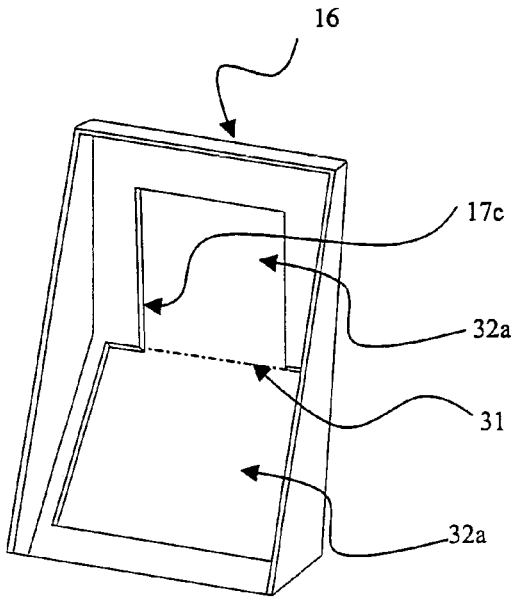
FIG. 3 is a schematic diagram of a top portion of a gaming console's doorframe with 1 open portal with 2 display means sections.

FIG. 2 depicts the upper portion 16 of a doorframe 15 of a gaming console 10, with 2 open portals 17*a* and 17*b* allowing differing size displays to be mounted on the doorframe 15 or within the gaming console 10 facing towards a person viewing the doorframes 15 frontal side. The viewing areas of the display means are angled in accordance with the open portals 17*a* and 17*b* to allow viewing of the display means 28*a* and 28*b*, with the display means being affixed to the interior of the doorframe 15, or the gaming console 10 allowing minimal gaps between the display means and the doorframe. Additionally, 41 depicts the obtuse angle the 2 display areas generally coincided when viewing the front surface of the doorframe where. Of course, the display means may be separated by a gap or curvature, whereby the actual vertex joining the 2 angles would meet at a corresponding point located behind the doorframe. FIG. 3 further depicts an upper portion 16 of a doorframe 15 with a single open portal 17*c* with 2 distinct sections 32*a* and 32*b* being substantially separated by a horizontal edge running coplanar with the top side of the section 32*a* and with the base section of 32*b* indicated by the dotted line 31 where the sides of each section 32*a* and 32*b* meet. The sections 32*a* and 32*b* of the open portal 17*c* are angled differently to again accommodate the angles required for a player to more comfortably view both displays. In an alternative embodiment the display means may also be mounted to either the gaming console 10 or doorframe 15 to allow a viewer to further adjust either display means 28*a* or 28*b* by changing the original angle of the display to adjust the viewing angle.

Figure 4:
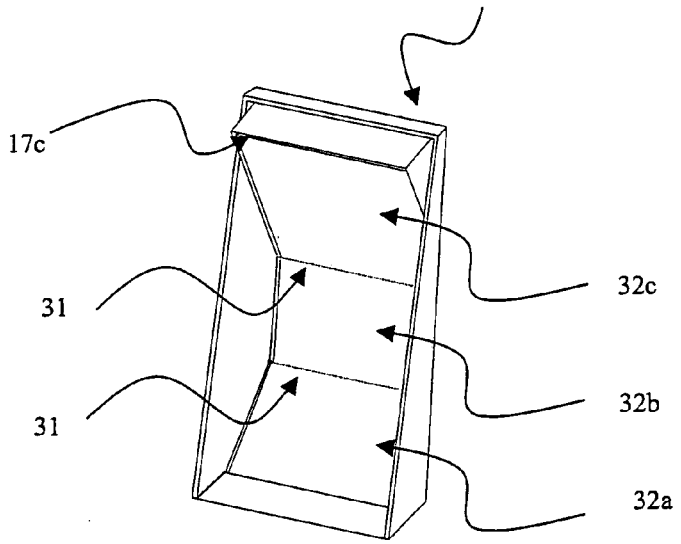
FIG. 4 is a schematic diagram of a top portion of a gaming console's doorframe with 1 open portal with 3 display means sections.

FIG. 4 illustrates an upper portion 16 embodiment using a doorframe 15 to be used by a gaming console 10. Similar to the embodiment in FIG. 3, the open portal 17*c* uses a single opening comprised of multiple sections 32*a* to 32*c*, to view multiple display means affixed to the doorframe itself, or to the actual gaming console. The sections are divided clearly by the incline or angle 31 for that section being different from at least one other section's angle.

Figure 5:
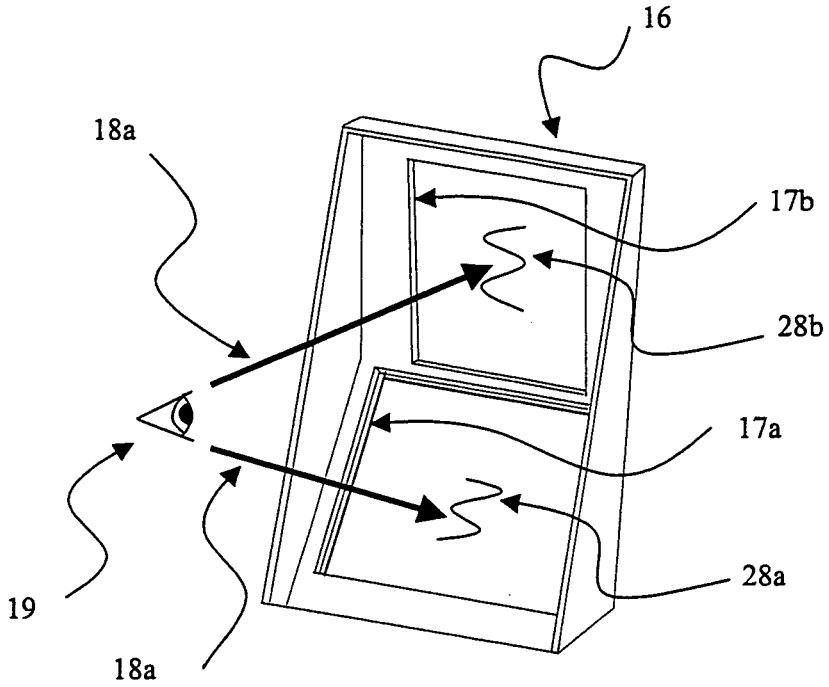
FIG. 5 is a schematic diagram of a top portion of a gaming console's doorframe illustrating the perspective of a player.

FIG. 5 simply demonstrates the benefit of using multiple angled displays on a doorframe 15, by showing a players 19 line of sight 18*a* and 18*b* when viewing multiple display areas 28*a* and 28*b* located in portals 17*a* and 17*b* respectively, to provide the player 19 with a more pleasurable viewing experience.

We claim:

1. Gaming machine, comprising a gaming machine cabinet (10) and a doorframe (15) hingedly attached thereto and pivotally movable around a substantially vertical edge between an open position and a closed position, at least two display monitors (28*a*, 28*b*) affixed to said doorframe (15) or said gaming machine cabinet (10) to be viewable through at least one opening (17*a*, 17*b*) in said doorframe (15) when said doorframe (15) is in the closed position, wherein said two display monitors (28*a*, 28*b*) are positioned one above the other at an obtuse angle relative to each other and are fixedly attached to said doorframe (15) and said doorframe (15) is supported on said gaming machine cabinet (10) by a substantially vertical hinge to open and close said doorframe together with the two display monitors (28*a*, 28*b*) affixed thereto relative to said gaming machine cabinet (10), and said doorframe (15) is provided below said two display monitors (28*a*, 28*b*) with a game control panel (20) running from one edge of the doorframe (15) to the other, wherein said game control panel (20) is inclined with respect to the two display monitors (28*a*, 28*b*) positioned above said game control panel (20), and wherein both the display monitors (28*a*, 28*b*) and the game control panel (20) are simultaneously moved to the open position relative to said gaming machine cabinet (10) upon opening of the doorframe (15) to provide access for maintenance to back sides of the display monitors (28*a*, 28*b*) and game control panel (20) and to interior components of the gaming machine cabinet (10).

2. Gaming machine according to claim 1, wherein at least one of said two display monitors (28*a*, 28*b*) is a cathode ray tube monitor.

3. Gaming machine according to claim 1, wherein said doorframe (15) comprises two separate open portals (17*a*, 17*b*) with an obtuse angle therebetween to allow viewing of the two display monitors (28*a*, 28*b*).

4. Gaming machine as claimed in claim 1, comprising one open portal (32) provided for at least two display monitors, said open portal including a section (32*a*, 32*b*) for each display means to be viewed therethrough, each section having a pair of left and right sides being substantially equal in angle, and a pair of top and base sides being substantially horizontal, either the top or base side of each section being substantially shared by another section of said open portal, and said pair of left and right side angles for each section at an obtuse angle to at least one other section of said pair of left and right sides when said doorframe (15) is viewed from the front.

5. Gaming machine as claimed in claim 1, wherein said doorframe (15) has more than one open portal to view said at least two display monitors, each open portal (17*a*, 17*b*) has a pair of left and right sides being substantially equal in angle, and a pair of substantially horizontal top and base sides, and each open portal of said pair of left and right sides being at an obtuse angle to at least one other open portal of said pair of left and right sides when said doorframe is viewed from the front.

6. Gaming machine as claimed in claim 1, wherein access to said at least two display monitors (28*a*, 28*b*) is achieved only by opening said doorframe (15).

7. Gaming machine according to claim 1, wherein said two display monitors (28*a*, 28*b*) are affixed to said doorframe (15) and said doorframe (15) is supported on said gaming machine cabinet (10) by a hinge to open and close said doorframe together with the two display monitors (28*a*, 28*b*) affixed thereto, relative to said gaming machine cabinet (10).

8. Gaming machine according to claim 7, wherein said doorframe (15) comprises two separate open portals (17*a*, 17*b*) with an obtuse angle therebetween to allow viewing of the two display monitors (28*a*, 28*b*).

9. Gaming machine according to claim 1, wherein said doorframe (15) comprises two separate open portals (17*a*, 17*b*) with an obtuse angle therebetween to allow viewing of the two display monitors (28*a*, 28*b*).

10. Gaming machine according to claim 2, wherein said doorframe (15) comprises two separate open portals (17*a*, 17*b*) with an obtuse angle therebetween to allow viewing of the two display monitors (28*a*, 28*b*).

11. Gaming machine as claimed in claim 10, comprising one open portal (32) provided for at least two display monitors, said open portal including a section (32*a*, 32*b*) for each display means to be viewed therethrough, each section having a pair of left and right sides being substantially equal in angle, and a pair of top and base sides being substantially horizontal, either the top or base side of each section being substantially shared by another section of said open portal, and said pair of left and right side angles for each section at an obtuse angle to at least one other section of said pair of left and right sides when said doorframe (15) is viewed from the front.

12. Gaming machine as claimed in claim 1, comprising one open portal (32) provided for at least two display monitors, said open portal including a section (32*a*, 32*b*) for each display means to be viewed therethrough, each section having a pair of left and right sides being substantially equal in angle, and a pair of top and base sides being substantially horizontal, either the top or base side of each section being substantially shared by another section of said open portal, and said pair of left and right side angles for each section at an obtuse angle to at least one other section of said pair of left and right sides when said doorframe (15) is viewed from the front.

13. Gaming machine as claimed in claim 2, comprising one open portal (32) provided for at least two display monitors, said open portal including a section (32*a*, 32*b*) for each display means to be viewed therethrough, each section having a pair of left and right sides being substantially equal in angle, and a pair of top and base sides being substantially horizontal, either the top or base side of each section being substantially shared by another section of said open portal, and said pair of left and right side angles for each section at an obtuse angle to at least one other section of said pair of left and right sides when said doorframe (15) is viewed from the front.

14. Gaming machine as claimed in claim 7, comprising one open portal (32) provided for at least two display monitors, said open portal including a section (32*a*, 32*b*) for each display means to be viewed therethrough, each section having a pair of left and right sides being substantially equal in angle, and a pair of top and base sides being substantially horizontal, either the top or base side of each section being substantially shared by another section of said open portal, and said pair of left and right side angles for each section at an obtuse angle to at least one other section of said pair of left and right sides when said doorframe (15) is viewed from the front.

15. Gaming machine as claimed in claim 1, wherein said doorframe (15) has more than one open portal to view said at least two display monitors, each open portal (17*a*, 17*b*) has a pair of left and right sides being substantially equal in angle, and a pair of substantially horizontal top and base sides, and each open portal of said pair of left and right sides being at an obtuse angle to at least one other open portal of said pair of left and right sides when said doorframe is viewed from the front.

16. Gaming machine as claimed in claim 2, wherein said doorframe (15) has more than one open portal to view said at least two display monitors, each open portal (17*a*, 17*b*) has a pair of left and right sides being substantially equal in angle, and a pair of substantially horizontal top and base sides, and each open portal of said pair of left and right sides being at an obtuse angle to at least one other open portal of said pair of left and right sides when said doorframe is viewed from the front.

17. Gaming machine as claimed in claim 7, wherein said doorframe (15) has more than one open portal to view said at least two display monitors, each open portal (17*a*, 17*b*) has a pair of left and right sides being substantially equal in angle, and a pair of substantially horizontal top and base sides, and each open portal of said pair of left and right sides being at an obtuse angle to at least one other open portal of said pair of left and right sides when said doorframe is viewed from the front.

18. Gaming machine as claimed in claim 17, wherein access to said at least two display monitors (28*a*, 28*b*) is achieved only by opening said doorframe (15).

19. Gaming machine as claimed in claim 14, wherein access to said at least two display monitors (28*a*, 28*b*) is achieved only by opening said doorframe (15).

20. A gaming machine comprising:

a gaming machine cabinet (10) and a doorframe (15) attached thereto, at least two display monitors (28*a*, 28*b*) placed behind said doorframe (15) at an interior space of said cabinet so as to be viewed through at least one opening (17*a*, 17*b*) in said doorframe (15) when said doorframe (15) is in its closed position, wherein said two display monitors (28*a*, 28*b*) are positioned one above the other at an obtuse angle relative to each other, and wherein said doorframe (15) is provided below said two display monitors (28*a*, 28*b*) with a game control panel (20) extending laterally from one side edge of the doorframe (15) to another side edge, wherein said two display monitors (28*a*, 28*b*) are securely affixed to said doorframe (15) and said doorframe (15) is supported on said gaming machine cabinet (10) by means of a vertical hinge extending along the full length of one side of the doorframe so as to open and close said doorframe together with the two display monitors (28*a*,

28*b*) and the game control panel (20) relative to said gaming machine cabinet (10), and wherein said game control panel (20) is inclined with respect to the two display monitors (28*a*, 28*b*) which are positioned above said game control panel (20), wherein said doorframe includes a rim extending upright alongside of the monitors (28*a*, 28*b*) and the game control panel (20), said rim having a straight edge along the entire doorframe height, and snugly fitting to the gaming machine cabinet (10), wherein said hinge is affixed to the full length of said rim and an inner wall of the gaming machine cabinet (10) and said hinge having a reinforcement to support the weight of the doorframe with the monitors and the game control panel affixed thereto.

21. The gaming machine of claim 20 wherein at least one of said display monitors (28*a*, 28*b*) is a cathode ray tube monitor.

22. The gaming machine of claim 1 wherein the display monitors define respective planes oriented to each other at an angle and meeting at a vertex, said vertex being located behind the doorframe.

* * * * *